US011028634B2

(12) United States Patent
Shimizu et al.

(10) Patent No.: US 11,028,634 B2
(45) Date of Patent: Jun. 8, 2021

(54) MANIPULATION DETECTING DEVICE FOR VEHICLE

(71) Applicants: AISIN SEIKI KABUSHIKI KAISHA, Kariya (JP); HONDA MOTOR CO., LTD., Tokyo (JP)

(72) Inventors: Ayaka Shimizu, Toyoake (JP); Hiroshi Shingu, Wako (JP); Kenichiro Kagawa, Wako (JP); Toshihiro Kaneda, Wako (JP)

(73) Assignees: AISIN SEIKI KABUSHIKI KAISHA, Kariya (JP); HONDA MOTOR CO., LTD., Tokyo (JP)

( * ) Notice: Subject to any disclaimer, the term of this patent is extended or adjusted under 35 U.S.C. 154(b) by 130 days.

(21) Appl. No.: 16/366,355

(22) Filed: Mar. 27, 2019

(65) Prior Publication Data

US 2019/0301232 A1 Oct. 3, 2019

(30) Foreign Application Priority Data

Mar. 29, 2018 (JP) ..... JP2018-065972

(51) Int. Cl.

| | |
|---|---|
| ***E05F 15/73*** | (2015.01) |
| ***E05B 81/78*** | (2014.01) |
| ***E05B 81/76*** | (2014.01) |

(52) U.S. Cl.

CPC ..... *E05F 15/73* (2015.01); *E05B 81/77* (2013.01); *E05B 81/78* (2013.01)

(58) Field of Classification Search

CPC ..... E05F 15/73; E05B 81/78; E05B 81/77; E05B 83/36; E05B 81/06; E05B 81/64; E05Y 2400/852; E05Y 2400/86; E05Y 2900/531; G01D 5/2417

See application file for complete search history.

(56) References Cited

U.S. PATENT DOCUMENTS

| | | | |
|---|---|---|---|
| 9,156,439 | B2 | 10/2015 | Hirota et al. |
| 2014/0312920 | A1 | 10/2014 | Hirota et al. |
| 2015/0012176 | A1 | 1/2015 | Schindler et al. |
| 2016/0137165 | A1 | 5/2016 | Schindler et al. |

(Continued)

FOREIGN PATENT DOCUMENTS

| | | | |
|---|---|---|---|
| CN | 105358389 | A | 2/2016 |
| JP | 2006213206 | A | 8/2006 |

(Continued)

*Primary Examiner* — Brian P Sweeney

(74) *Attorney, Agent, or Firm* — Buchanan Ingersoll & Rooney PC

(57) ABSTRACT

A manipulation detecting device for a vehicle includes a sensor electrode that is configured to have a capacitance that increases as a detection target approaches the sensor electrode and circuitry that is configured to selectively open and close an opening-closing body of a vehicle by controlling an actuator. A first determination value is used to determine proximity of the detection target to the sensor electrode. The circuitry is configured to selectively open and close the opening-closing body when the opening-closing body is in a stopped state and the capacitance of the sensor electrode is greater than or equal to the first proximity determination value and smaller than a second proximity determination value, which is greater than the first proximity determination value.

6 Claims, 5 Drawing Sheets

(56) References Cited

U.S. PATENT DOCUMENTS

| | | | | |
|---|---|---|---|---|
| 2017/0241187 | A1 | 8/2017 | Takayanagi | |
| 2018/0252017 | A1* | 9/2018 | Hayashi | B60J 5/10 |

FOREIGN PATENT DOCUMENTS

| | | | |
|---|---|---|---|
| JP | 2010254262 | A | 11/2010 |
| JP | 2013113626 | A | 6/2013 |
| JP | 2014122542 | A | 7/2014 |
| JP | 2014212044 | A | 11/2014 |
| JP | 2017150222 | A | 8/2017 |

* cited by examiner

MANIPULATION DETECTING DEVICE FOR VEHICLE

BACKGROUND

The present disclosure relates to a manipulation detecting device for a vehicle.

Japanese Laid-Open Patent Publication No. 2006-213206 describes a vehicle window sensor including a sensor electrode and a capacitive sensor. The sensor electrode is disposed in a window glass of a vehicle. The capacitive sensor detects the capacitance between the sensor electrode and the body of the vehicle. The vehicle window sensor detects the proximity of the user to the vehicle based on a change in the capacitance and then permits automatic unlocking and opening of the door.

However, the capacitance, which is detected by the vehicle window sensor, may also change when the user, for example, leans on the window glass. This may cause the vehicle window sensor to open the door when undesired.

The problem is not limited to the vehicle window sensor, which operates the door in response to the proximity of the user to the vehicle, but is generally common in manipulation detecting devices for vehicles as well. A manipulation detecting device is manipulated by the user to operate an opening-closing body of a vehicle.

Accordingly, it is an objective of the present disclosure to provide a manipulation detecting device for a vehicle capable of preventing an opening-closing body from being operated due to a false detection of a user manipulation.

SUMMARY

In accordance with one aspect of the present disclosure, a manipulation detecting device for a vehicle is provided. The manipulating detecting device includes a sensor electrode that is configured to have a capacitance that increases as a detection target approaches the sensor electrode and circuitry that is configured to selectively open and close an opening-closing body of a vehicle by controlling an actuator. A determination value that is used to determine proximity of the detection target to the sensor electrode is a first proximity determination value. A determination value greater than the first proximity determination value is a second proximity determination value. The circuitry is configured to selectively open and close the opening-closing body when the opening-closing body is in a stopped state and the capacitance of the sensor electrode is greater than or equal to the first proximity determination value and smaller than the second proximity determination value.

If the user manipulates the manipulation detecting device for a vehicle normally, the user can maintain a predetermined distance between a part of his or her body and the manipulation detecting device. However, when the manipulation detecting device is not manipulated normally as in a case in which the user leans on the manipulation detecting device, the user may not be able to maintain the predetermined distance between a part of his or her body and the manipulation detecting device. Specifically, the distance between a part of his or her body and the manipulation detecting device tends to be shorter than the aforementioned predetermined distance.

Thus, the manipulation detecting device selectively opens and closes the opening-closing body when the capacitance of the sensor electrode is greater than or equal to the first proximity determination value and smaller than the second proximity determination value. In other words, when the detection target is excessively close to the main electrode, that is, when the capacitance of the sensor electrode is greater than or equal to the second proximity determination value, the manipulation detecting device for a vehicle restricts operation of the opening-closing body. Thus, the manipulation detecting device can prevent the opening-closing body from being operated when the manipulation detecting device is not manipulated normally. That is, the manipulation detecting device prevents the opening-closing body from being operated due to a false detection of a user manipulation.

Other aspects and advantages of the present disclosure will become apparent from the following description, taken in conjunction with the accompanying drawings, illustrating exemplary embodiments.

BRIEF DESCRIPTION OF THE DRAWINGS

The disclosure may be understood by reference to the following description together with the accompanying drawings.

DETAILED DESCRIPTION

A manipulation detecting device for a vehicle (hereinafter, also referred to as a detecting device) according to an embodiment will be described with reference to the drawings.

Figure 1:
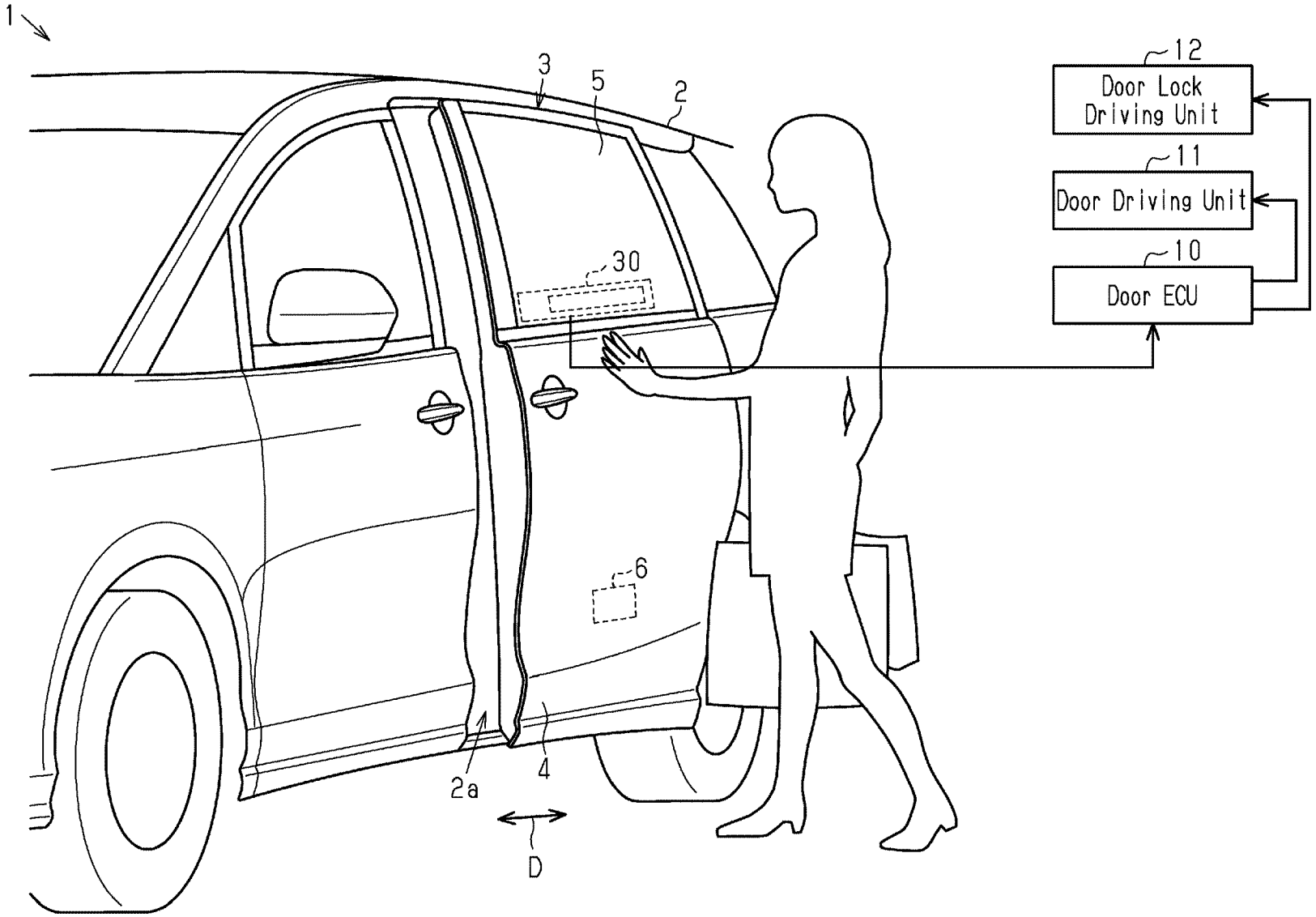
FIG. 1 is a diagram schematically showing a vehicle including a manipulation detecting device for a vehicle according to an embodiment.

As shown in FIG. 1, an opening 2*a* is provided in a side section of a body 2 of a vehicle 1 such as an automobile. A sliding vehicle door 3 is mounted in the side section of the body 2 as an example of an opening-closing body and selectively opens and closes the opening 2*a* by moving in the vehicle front-rear direction. The vehicle door 3 has a substantially bag-like door body 4 and a window glass 5. The door body 4 configures a lower section of the vehicle door 3. The window glass 5 selectively proceeds and retreats from the door body 4 in the up-down direction. A door lock 6 is installed in the door body 4 to selectively lock and unlock the vehicle door 3 when the vehicle door 3 is closed.

A door driving unit 11 is installed in the door body 4, for example, of the vehicle door 3. The door driving unit 11 is configured mainly by an electric drive source such as an electric motor and mechanically linked with the body 2 through a non-illustrated door driving mechanism to selectively open and close the vehicle door 3. In the present embodiment, the door driving unit 11 corresponds to an example of an actuator for selectively opening and closing the vehicle door 3.

The vehicle door 3 also has a door lock driving unit 12, for example, adjacently to the door lock 6. The door lock driving unit 12 is configured mainly by an electric drive source such as an electric motor. The door lock driving unit 12 is mechanically linked with the door lock 6 through any suitable lock driving mechanism to selectively lock and unlock the door lock 6.

The door driving unit 11 and the door lock driving unit 12 are both electrically connected to a door ECU 10. The door ECU 10 is configured by a microcomputer or the like and controls the door driving unit 11 and the door lock driving unit 12 independently from each other. When the door ECU 10 receives an opening command signal from an electronic key (a portable device) and a detecting device 30, as will be described later, the door ECU 10 drives the door driving unit 11 to open the vehicle door 3. If the door ECU 10 receives a closing command signal from the electronic key and the detecting device 30, the door ECU 10 drives the door driving unit 11 to close the vehicle door 3. If the door ECU 10 receives a stopping command signal from the electronic key and the detecting device 30, the door ECU 10 stops the door driving unit 11 to stop the vehicle door 3 as the vehicle door 3 is opening or closing.

Figure 2:
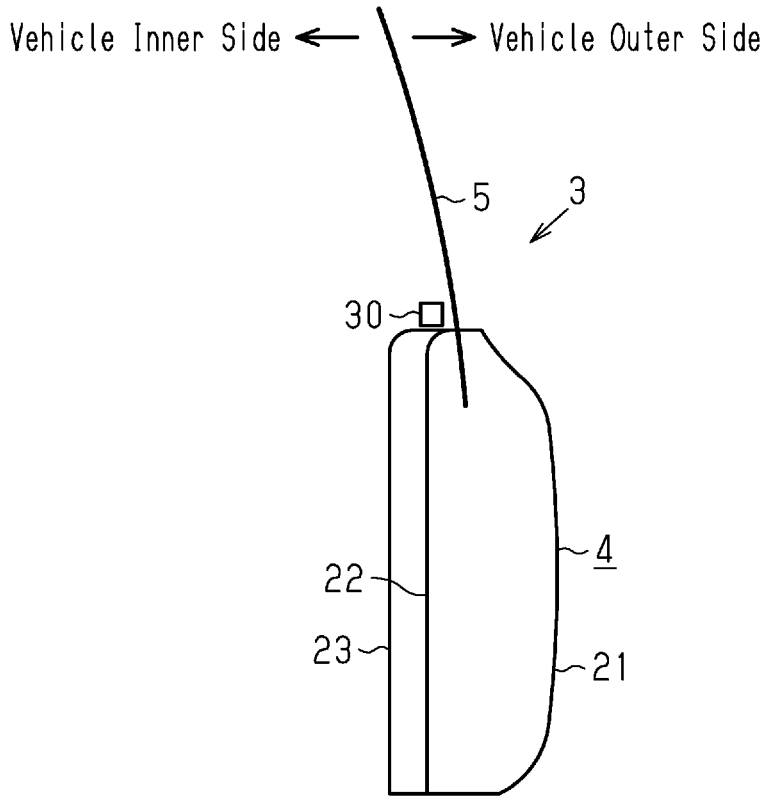
FIG. 2 is a cross-sectional view schematically illustrating the configuration of a vehicle door of FIG. 1.

As illustrated in FIG. 2, substantially plate-like outer door panel 21 and inner door panel 22 are each formed by, for example, a metal plate. An open end of the outer door panel 21 and an open end of the inner door panel 22 are joined to each other such that the door body 4 is molded substantially in a bag-like shape. A door trim 23 is attached to the inner door panel 22 as a decoration in the passenger compartment of the vehicle 1. The detecting device 30 is disposed above the door trim 23 and detects the manipulation by the user from outside the vehicle.

The detecting device 30 will now be described with reference to FIG. 3.

Figure 3:
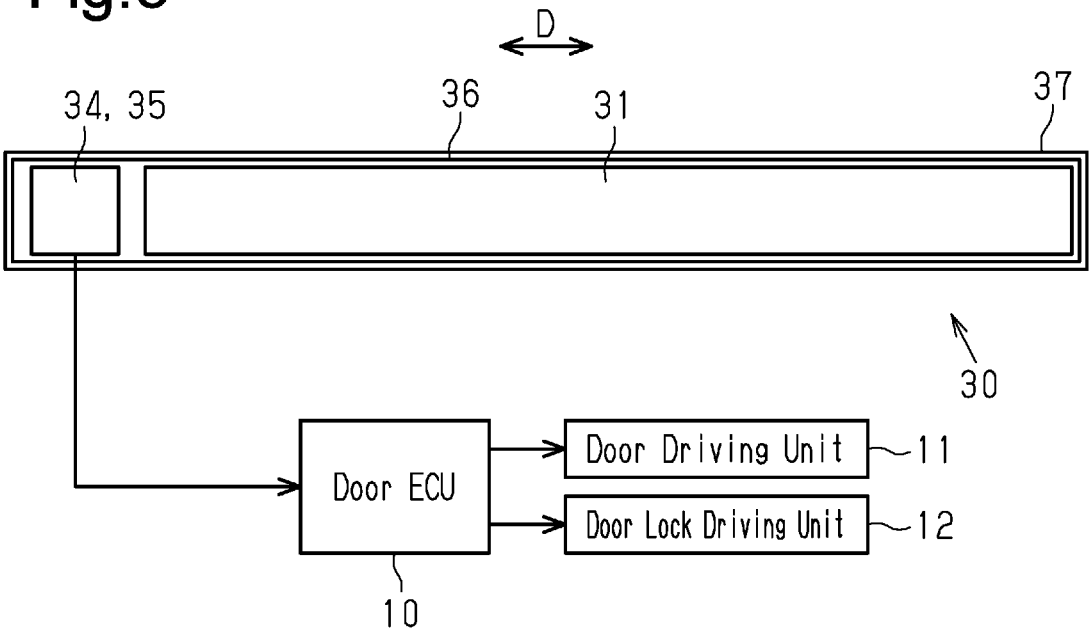
FIG. 3 is a diagram schematically illustrating the configuration of the manipulation detecting device for a vehicle of FIG. 1.

With reference to FIG. 3, the detecting device 30 includes a sensor electrode 31, a detection circuit 34, a control circuit 35, a substrate 36, and a casing 37. The sensor electrode 31 extends in the opening-closing direction D of the vehicle door 3. The detection circuit 34 is electrically connected to the sensor electrode 31. The control circuit 35 outputs a control signal to the door ECU 10. The sensor electrode 31, the detection circuit 34, and the control circuit 35 are mounted on the substrate 36. The casing 37 accommodates the components of the detecting device 30. The longitudinal direction of the sensor electrode 31 coincides with the opening-closing direction D of the vehicle door 3.

As shown in FIGS. 1 and 3, the detecting device 30 (the casing 37) has an elongated and substantially parallelepiped shape. The longitudinal dimension of the casing 37 is smaller than the front-rear dimension of the window glass 5 of the vehicle door 3.

With reference to FIG. 3, the sensor electrode 31 has a substantially rectangular plate-like shape. It is preferable that the sensor electrode 31 have a dimension in the opening-closing direction D that corresponds to the dimension of the hand of the user (for example, several centimeters to several tens of centimeters).

The sensor electrode 31 configures, together with a detection target close to the sensor electrode 31, a capacitor temporarily. The capacitance of the sensor electrode 31 varies depending on the position of the sensor electrode 31 relative to the detection target. The closer to the sensor electrode 31 the detection target, the greater the capacitance becomes. Also, the sensor electrode 31 is arranged such that the detection range enlarges to the outer side of the vehicle, so that, as the detection target approaches the sensor electrode 31 from outside the vehicle, the capacitance increases. Hereinafter, the capacitance, which varies depending on the position of the sensor electrode 31 and the position of the detection target relative to each other, will be referred to as the capacitance Cv of the sensor electrode 31 or the capacitance Cv.

In the present embodiment, a proximity determination value Cth1 and a contact determination value Cth2 are set for the detecting device 30. The proximity determination value Cth1 is an example of the first proximity determination value, with reference to which a determination that the detection target is in proximity of the sensor electrode 31 is made. The contact determination value Cth2 is an example of the second proximity determination value, which is greater than the proximity determination value Cth1.

Specifically, the detecting device 30 determines that the detection target is in proximity of the sensor electrode 31 if the capacitance Cv is greater than or equal to the proximity determination value Cth1 and that the detection target is not in proximity of the sensor electrode 31 if the capacitance Cv is smaller than the proximity determination value Cth1. Also, the detecting device 30 determines that the detection target is closest to the sensor electrode 31 if the capacitance Cv is greater than or equal to the contact determination value Cth2. In the present embodiment, the detecting device 30 is arranged to the inner side of the window glass 5. Therefore, when a determination that the detection target is closest to the sensor electrode 31 is made, the detection target is in proximity of the sensor electrode 31 while contacting the window glass 5. Specifically, it is preferable to determine the proximity determination value Cth1 and the contact determination value Cth2 with the sensitivity of the detecting device 30 taken into consideration.

The detection circuit 34 outputs an oscillation signal to the sensor electrode 31, thus causing the sensor electrode 31 to output a signal corresponding to the capacitance Cv. The signal output from the sensor electrode 31 is then AD converted (analog-digital converted) by the detection circuit 34. The detection circuit 34 then outputs the signal to the control circuit 35.

The control circuit 35 performs various types of calculation procedures based on the signal output from the detection circuit 34 and outputs a control signal corresponding to the result of the calculation procedures to the door ECU 10. Specifically, in correspondence with the capacitance Cv, the control circuit 35 outputs an opening command signal for opening the vehicle door 3, a closing command signal for closing the vehicle door 3, and a stopping command signal for stopping the vehicle door 3 to the door ECU 10. In this regard, the control circuit 35 of the present embodiment corresponds to an example of a control section for selectively opening and closing the opening-closing body.

When manipulation by the user changes the capacitance Cv in a manner satisfying specific conditions, the control circuit 35 of the detecting device 30 outputs the opening command signal, the closing command signal, or the stopping command signal to the door ECU 10.

The conditions for outputting the opening command signal, the closing command signal, and the stopping command signal from the control circuit 35 to the door ECU 10 will hereafter be described.

In the present embodiment, the detecting device 30 is disposed at the window glass 5 of the vehicle door 3. In this case, the capacitance Cv may change if the user leans on the vehicle door 3. In a detecting device of a comparative example, an opening command signal or a closing command signal is output if the condition that the capacitance Cv is greater than or equal to the proximity determination value Cth1 is satisfied. This may erroneously open or close the vehicle door 3 when the user leans on the vehicle door 3. However, if the user elaborately brings his or her hand close to the detecting device 30 (the sensor electrode 31), he or she can do so without contacting the window glass 5.

Therefore, the control circuit 35 outputs the opening command signal or the closing command signal when the condition that the hand of the user, for example, remains close to the sensor electrode 31 continuously for a certain amount of time is satisfied. Specifically, the control circuit 35 outputs the opening command signal or the closing command signal if the three conditions described below remain satisfied continuously for a first determination time Tth1. The three conditions include first, second, and third conditions. The first condition is that the vehicle door 3 is in a stopped state. The second condition is that the capacitance Cv is greater than or equal to the proximity determination value Cth1. The third condition is that the capacitance Cv is smaller than the contact determination value Cth2. The first determination time Tth1 may be determined as needed with the manipulability for the user taken into consideration and thus be approximately one second, by way of example.

On the other hand, if the vehicle door 3 is opening or closing and the capacitance Cv remains greater than or equal to the contact determination value Cth2 continuously for a second determination time Tth2, the detecting device 30 outputs the stopping command signal. In other words, the detecting device 30 stops the vehicle door 3 if the hand of the user contacts the window glass 5 continuously and remains close to the sensor electrode 31. The second determination time Tth2 is shorter than the first determination time Tth1 and may be, by way of example, approximately 0.5 seconds.

Next, with reference to the flowchart in FIG. 4, the procedure executed by the control circuit 35 to selectively open and close the vehicle door 3 will be described. The procedure is carried out at predetermined control cycles when the vehicle door 3 is located at a full-open position or a full-closed position.

Figure 4:
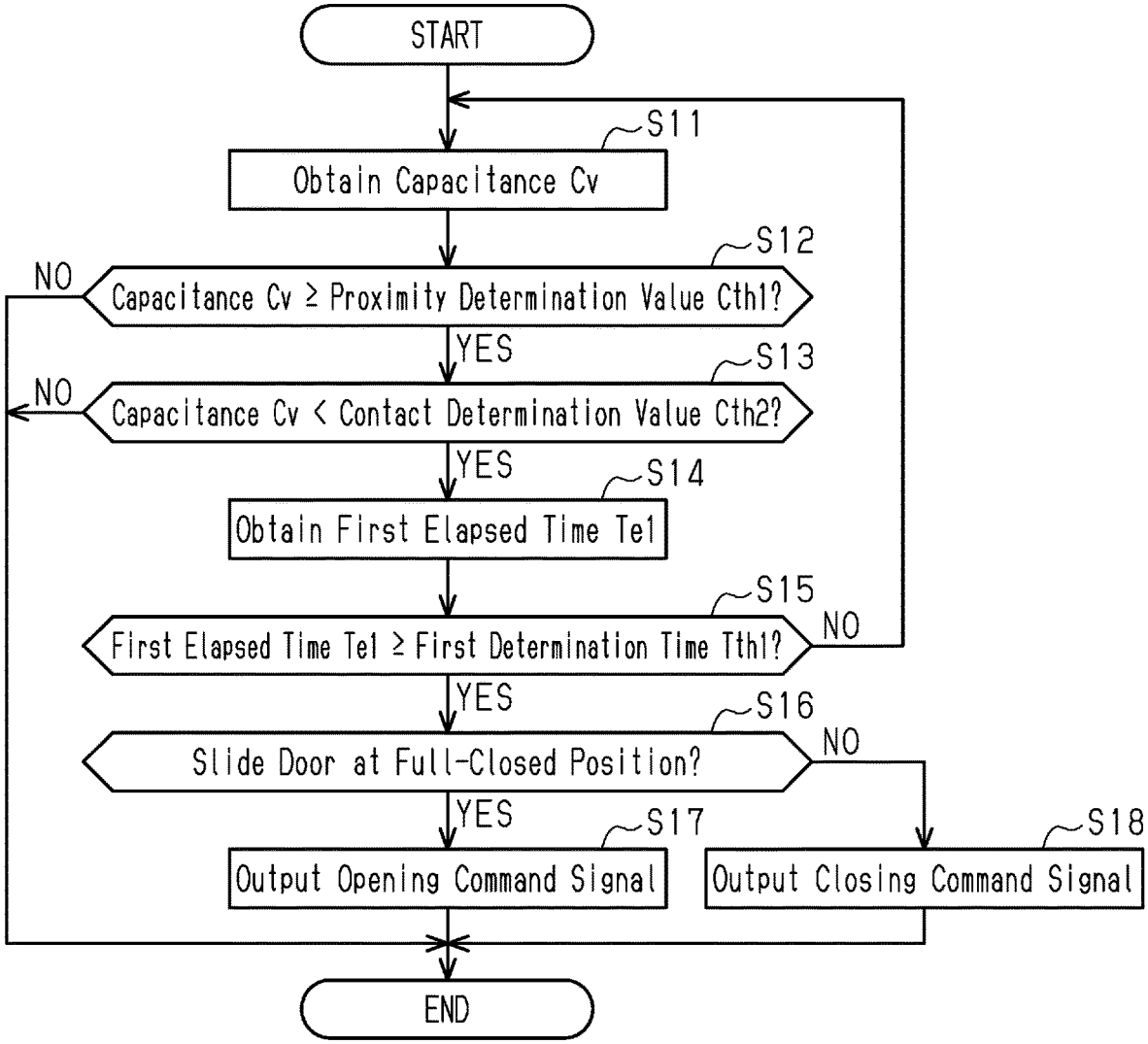
FIG. 4 is a flowchart representing a procedure executed by a control circuit to selectively open and close a vehicle door.

As shown in FIG. 4, the control circuit 35 obtains the capacitance Cv (Step S11). The control circuit 35 then determines whether the capacitance Cv is greater than or equal to the proximity determination value Cth1 (Step S12). If the capacitance Cv is smaller than the proximity determination value Cth1 (Step S12: NO), that is, the hand of the user is not in proximity of the sensor electrode 31, the control circuit 35 ends the procedure.

In contrast, if the capacitance Cv is greater than or equal to the proximity determination value Cth1 (Step S12: YES), that is, the hand of the user is in proximity of the sensor electrode 31, the control circuit 35 determines whether the capacitance Cv is smaller than the contact determination value Cth2 (Step S13). If the capacitance Cv is greater than or equal to the contact determination value Cth2 (Step S13: NO), that is, the user leans on the window glass 5, for example, the control circuit 35 ends the procedure. In contrast, if the capacitance Cv is smaller than the contact determination value Cth2 (Step S13: YES), that is, the hand of the user does not contact the window glass 5, the control circuit 35 obtains a first elapsed time Te1 (Step S14). The first elapsed time Te1 is the time that has elapsed since an initial positive determination is made in Step S13. The first elapsed time Te1 is thus updated each time Step S14 is carried out until the procedure shown in FIG. 4 is ended.

Subsequently, the control circuit 35 determines whether the first elapsed time Te1 is longer than or equal to the first determination time Tth1 (Step S15). If the first elapsed time Te1 is smaller than the first determination time Tth1 (Step S15: NO), the control circuit 35 performs Step S11. In contrast, if the first elapsed time Te1 is longer than or equal to the first determination time Tth1 (Step S15: YES), the control circuit 35 determines whether the vehicle door 3 is located at the full-closed position (Step S16). If the vehicle door 3 is located at the full-closed position (Step S16: YES), the control circuit 35 outputs the opening command signal to the door ECU 10 to open the vehicle door 3 (Step S17). In contrast, when the vehicle door 3 is located at the full-open position (Step S16: NO), the control circuit 35 outputs the closing command signal to the door ECU 10 to close the vehicle door 3 (Step S18).

Next, with reference to the flowchart in FIG. 5, the procedure executed by the control circuit 35 to stop the vehicle door 3 while the vehicle door 3 is opening or closing will be described. The procedure is carried out at predetermined control cycles while the vehicle door 3 is opening or closing.

Figure 5:
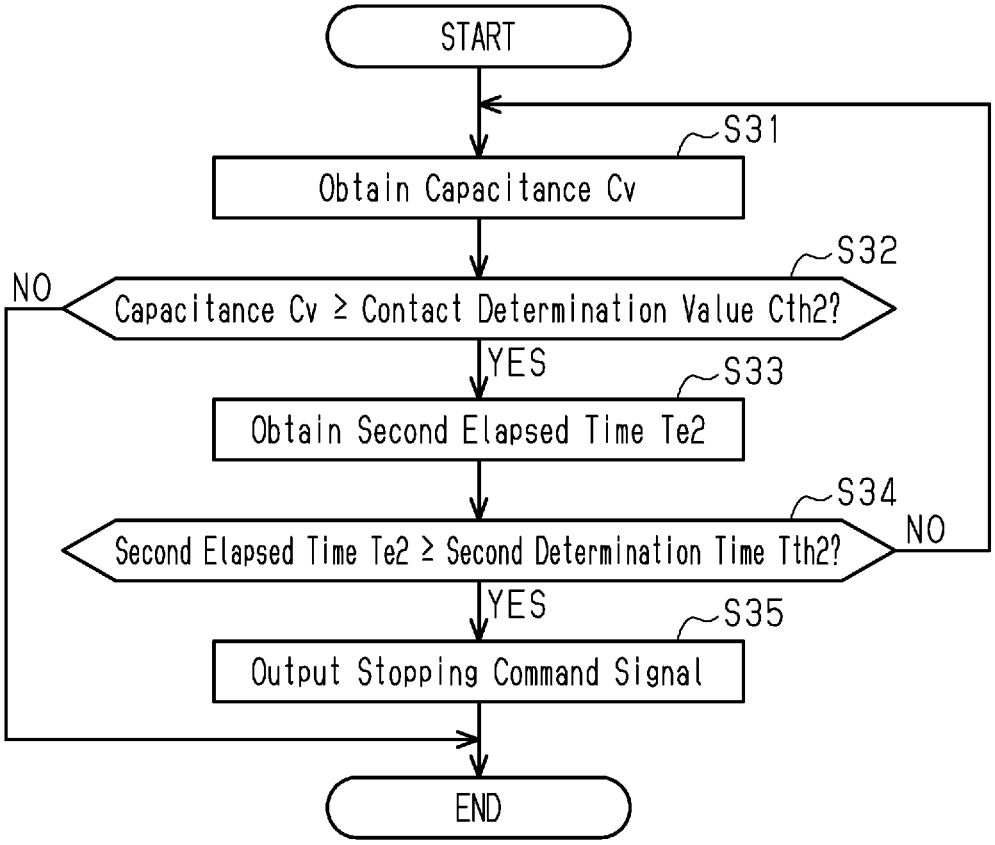
FIG. 5 is a flowchart representing a procedure executed by the control circuit to stop the vehicle door.

As illustrated in FIG. 5, the control circuit 35 obtains the capacitance Cv (Step S31). The control circuit 35 then determines whether the capacitance Cv is greater than or equal to the contact determination value Cth2 (Step S32). If the capacitance Cv is smaller than the contact determination value Cth2 (Step S32: NO), the control circuit 35 ends the procedure. In contrast, if the capacitance Cv is greater than or equal to the contact determination value Cth2 (Step S32: YES), the control circuit 35 obtains a second elapsed time Te2 (Step S33). The second elapsed time Te2 is the time that has elapsed since an initial positive determination is made in Step S32. The second elapsed time Te2 is thus updated each time Step S33 is carried out until the procedure of FIG. 5 is ended.

Subsequently, the control circuit 35 determines whether the second elapsed time Te2 is longer than or equal to a second determination time Tth2 (Step S34). If the second elapsed time Te2 is smaller than the second determination time Tth2 (Step S34: NO), the control circuit 35 carries out Step S31. In contrast, if the second elapsed time Te2 is longer than or equal to the second determination time Tth2 (Step S34: YES), the control circuit 35 outputs the stopping command signal to the door ECU 10 (Step S35). Then, the control circuit 35 ends the procedure.

Operation of the present embodiment will now be described with reference to FIGS. 6 and 7.

First, with reference to FIG. 6, the case in which the vehicle door 3 is located at the full-closed position and the user manipulates the detecting device 30 to open the vehicle door 3 will be described.

Figure 6:
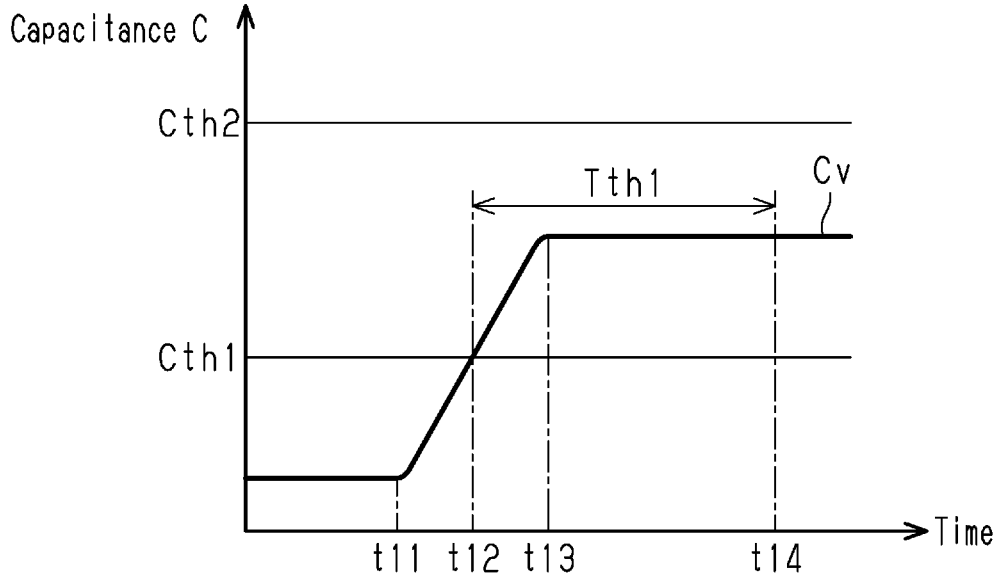
FIG. 6 is a timing diagram representing changes in capacitance caused by the user manipulating the manipulation detecting device for a vehicle to open the vehicle door.

As shown in FIG. 6, at a first point in time t11, the user starts to manipulate the detecting device 30 and the hand of the user enters the detection range of the sensor electrode 31. Therefore, after the first point in time t11, the capacitance Cv gradually becomes greater. Then, at a second point in time t12, the hand of the user is approaching the sensor electrode 31 and the capacitance Cv becomes greater than or equal to the proximity determination value Cth1. Subsequently, at a third point in time t13, the approach of the user's hand comes to an end. After the third point in time t13, the capacitance Cv remains unchanged. At a fourth point in time t14, the time that has elapsed after the second point in time t12 becomes equal to the first determination time Tth1. This satisfies the conditions for opening the vehicle door 3. Specifically, the capacitance Cv remains greater than or equal to the proximity determination value Cth1 and smaller than the contact determination value Cth2 during the period from the second point in time t12 to the fourth point in time t14. In other words, the conditions for opening the vehicle door 3 cannot be satisfied at the fourth point in time t14 if even one of the above-described three conditions is not satisfied in the period from the second point in time t12 to the fourth point in time t14.

Subsequently, with reference to FIG. 7, the case in which the vehicle door 3 is opening or closing and the user manipulates the detecting device 30 to stop the vehicle door 3 will be described.

Figure 7:
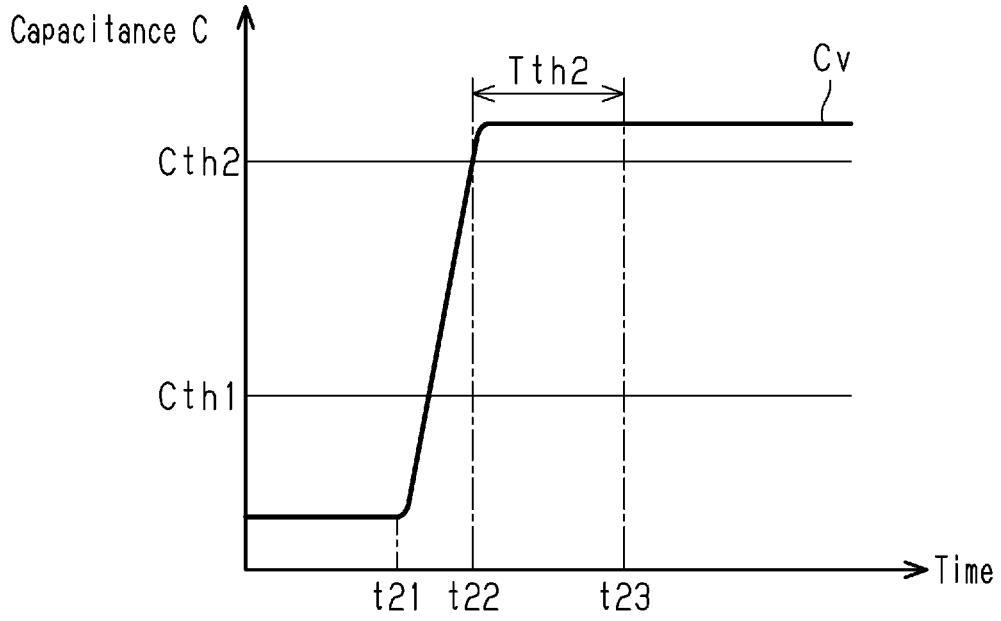
FIG. 7 is a timing diagram representing changes in capacitance caused by the user manipulating the manipulation detecting device for a vehicle to stop the vehicle door.

As shown in FIG. 7, at a first point in time t21, the user starts to manipulate the detecting device 30 and the hand of the user enters the detection range of the sensor electrode 31. Therefore, after the first point in time t21, the capacitance Cv gradually becomes greater. Then, at a second point in time t22, the hand of the user is approaching the sensor electrode 31 and the capacitance Cv becomes greater than or equal to the contact determination value Cth2. Subsequently, at a third point in time t23, the time that has elapsed after the second point in time t22 becomes equal to the second determination time Tth2. This satisfies the condition for stopping the vehicle door 3. Specifically, the capacitance Cv remains greater than or equal to the contact determination value Cth2 during the period from the second point in time t22 to the third point in time t23.

The present embodiment has the following advantages.

(1) If the capacitance Cv is greater than or equal to the contact determination value Cth2, which is greater than the proximity determination value Cth1, the detecting device 30 restricts the output of the opening command signal or the closing command signal. This allows the detecting device 30 to prohibit the opening and closing of the vehicle door 3 when the user inadvertently touches the window glass 5 by hand or if the vehicle is being washed and the water hits the window glass 5.

(2) The detecting device 30 is allowed to selectively facilitate and hamper the opening and closing of the vehicle door 3 depending on the setting of the first determination time Tth1. That is, the first determination time Tth1 may be set in a manner changing the accuracy of detecting manipulation by the user.

(3) When the capacitance Cv remains greater than or equal to the contact determination value Cth2 continuously for the second determination time Tth2 or longer, the detecting device 30 outputs the stopping command signal to the vehicle door 3. The second determination time Tth2 is shorter than the first determination time Tth1. This allows the detecting device 30 to stop the vehicle door 3 quickly if the user intends to stop the opening or closing of the vehicle door 3. Also, the detecting device 30 does not output the stopping command signal simply because the capacitance Cv is greater than or equal to the contact determination value Cth2. Therefore, when the user inadvertently brings his or her hand close to the detecting device 30, the stopping of the vehicle door 3 is avoided.

The present embodiment may be modified as follows. The present embodiment and the following modifications can be combined as long as the combined modifications remain technically consistent with each other.

In Step S32 in FIG. 5, the contact determination value Cth2, to which the capacitance Cv is compared, may be replaced by the proximity determination value Cth1. Also, in Step S34 in FIG. 5, the second determination time Tth2, to which the second elapsed time Te2 is compared, may be replaced by the first determination time Tth1.

The first determination time Tth1 and the second determination time Tth2 may both be set to an appropriate value according to preference of the user.

The user may manipulate the detecting device 30 not only by hand but also using any part of his or her body, such as the arm or shoulder. The user may also use an object that he or she carries by hand to manipulate the detecting device 30.

The detecting device 30 does not necessarily have to be disposed in the vehicle door 3. The detecting device 30 may be arranged in, for example, the body 2 of the vehicle 1.

The opening-closing body may be a swing door or a back door, each as an example of the vehicle door 3. Alternatively, the opening-closing body may be the window glass 5, which is driven and selectively opened and closed by an actuator. In this case, it is preferable to arrange the sensor electrode 31 in a manner aligned with the opening-closing body in the opening-closing direction D of the opening-closing body.

The control circuit 35 may be circuitry including 1) one or more processors that execute at least part of various processes according to a computer program (software), 2) one or more dedicated hardware circuits such application specific integrated circuits (ASIC) that execute at least part of various processes, or 3) a combination thereof. The processor includes a CPU and memories such as a RAM and a ROM. The memories store program codes or commands configured to cause the CPU to execute processes. The memory, or storage medium, includes any type of medium that is accessible by general-purpose computers and dedicated computers.

The invention claimed is:

1. A manipulation detecting device for a vehicle comprising:

a sensor electrode that is configured to have a capacitance that increases as a detection target approaches the sensor electrode; and circuitry that is configured to selectively open and close an opening-closing body of a vehicle by controlling an actuator, wherein the circuitry is configured to selectively open and close the opening-closing body when the opening-closing body is in a stopped state and the capacitance of the sensor electrode is greater than or equal to a first proximity determination value and smaller than a second proximity determination value, the first proximity determination value being used to determine proximity of the detection target to the sensor electrode, and the second proximity determination value being greater than the first proximity determination value.

2. The manipulation detecting device for a vehicle according to claim 1, wherein the circuitry is configured to selectively open and close the opening-closing body when the opening-closing body is in a stopped state and the capacitance of the sensor electrode remains greater than or equal to the first proximity determination value and smaller than the second proximity determination value continuously for a first determination time.

3. The manipulation detecting device for a vehicle according to claim 1, wherein the second proximity determination value is used to determine contact of the detection target with the vehicle.

4. The manipulation detecting device for a vehicle according to claim 1, wherein the circuitry is configured to prohibit the opening and closing of the opening-closing body when the opening-closing body is in a stopped state and the capacitance of the sensor electrode is greater than or equal to the second proximity determination value.

5. A manipulation detecting device for a vehicle comprising:

a sensor electrode that is configured to have a capacitance that increases as a detection target approaches the sensor electrode; and circuitry that is configured to selectively open and close an opening-closing body of a vehicle by controlling an actuator, wherein the circuitry is configured to selectively open and close the opening-closing body when the opening-closing body is in a stopped state and the capacitance of the sensor electrode remains greater than or equal to a first proximity determination value and smaller than a second proximity determination value continuously for a first determination time, the first proximity determination value being used to determine proximity of the detection target to the sensor electrode, and the second proximity determination value being greater than the first proximity determination value, the circuitry is further configured to stop the opening-closing body when the opening-closing body is being opened or closed and the capacitance of the sensor electrode remains greater than or equal to the first proximity determination value continuously for a second determination time or longer, the second determination time being shorter than the first determination time.

6. A manipulation detecting device for a vehicle comprising:

a sensor electrode that is configured to have a capacitance that increases as a detection target approaches the sensor electrode; and circuitry that is configured to selectively open and close an opening-closing body of a vehicle by controlling an actuator, wherein the circuitry is configured to selectively open and close the opening-closing body such that, when the opening-closing body is in a stopped state and the capacitance of the sensor electrode is greater than or equal to a lower threshold and smaller than an upper threshold, the opening-closing body is opened or closed, and when the capacitance of the sensor is smaller than the lower threshold or greater than or equal to the upper threshold, the opening-closing body is not opened or closed.

* * * * *